US007275966B2

(12) United States Patent
Poh et al.

(10) Patent No.: US 7,275,966 B2
(45) Date of Patent: Oct. 2, 2007

(54) CONNECTOR WITH HEAT DISSIPATING FEATURES

(75) Inventors: Edmund W. M. Poh, Lisle, IL (US); Lily T. C. Chang, Lisle, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/538,487

(22) PCT Filed: Dec. 11, 2003

(86) PCT No.: PCT/US03/39595

§ 371 (c)(1),
(2), (4) Date: Jun. 8, 2005

(87) PCT Pub. No.: WO2004/062042

PCT Pub. Date: Jul. 22, 2004

(65) Prior Publication Data

US 2006/0063405 A1 Mar. 23, 2006

(51) Int. Cl.
*H01R 24/00* (2006.01)

(52) U.S. Cl. ..... 439/636; 439/485

(58) Field of Classification Search ..... 439/60, 439/636, 637, 485

See application file for complete search history.

(56) References Cited

U.S. PATENT DOCUMENTS

| | | | | | |
|---|---|---|---|---|---|
| 3,199,066 | A | * | 8/1965 | Eledge et al. | 439/857 |
| 3,422,394 | A | * | 1/1969 | Antes | 439/637 |
| 3,555,493 | A | * | 1/1971 | Baumanis | 439/636 |
| 3,646,504 | A | * | 2/1972 | Classon | 439/188 |
| 4,129,351 | A | * | 12/1978 | Sugimoto et al. | 439/325 |
| 4,780,095 | A | * | 10/1988 | Classon et al. | 439/637 |
| 5,192,220 | A | * | 3/1993 | Billman et al. | 439/327 |
| 5,387,133 | A | * | 2/1995 | Tondreault et al. | 439/637 |
| 5,401,185 | A | * | 3/1995 | Wang et al. | 439/441 |
| 5,411,408 | A | * | 5/1995 | DiViesti et al. | 439/326 |
| 5,711,690 | A | * | 1/1998 | Thrush et al. | 439/862 |
| 5,775,950 | A | * | 7/1998 | Tsuji | 439/637 |

* cited by examiner

*Primary Examiner*—Thanh-Tam Le
(74) *Attorney, Agent, or Firm*—Robert J. Zeitler

(57) ABSTRACT

A connector includes a housing having a plurality of spaced apart ribs. A slot is defined between adjacent ribs. The slots are open to the outer sides of the housing. A terminal positioned within each slot and is connected to the housing. This provides for the terminals to be substantially exposed to the environment so that air can flow over the terminals to dissipate heat therefrom.

14 Claims, 6 Drawing Sheets

FIG.9
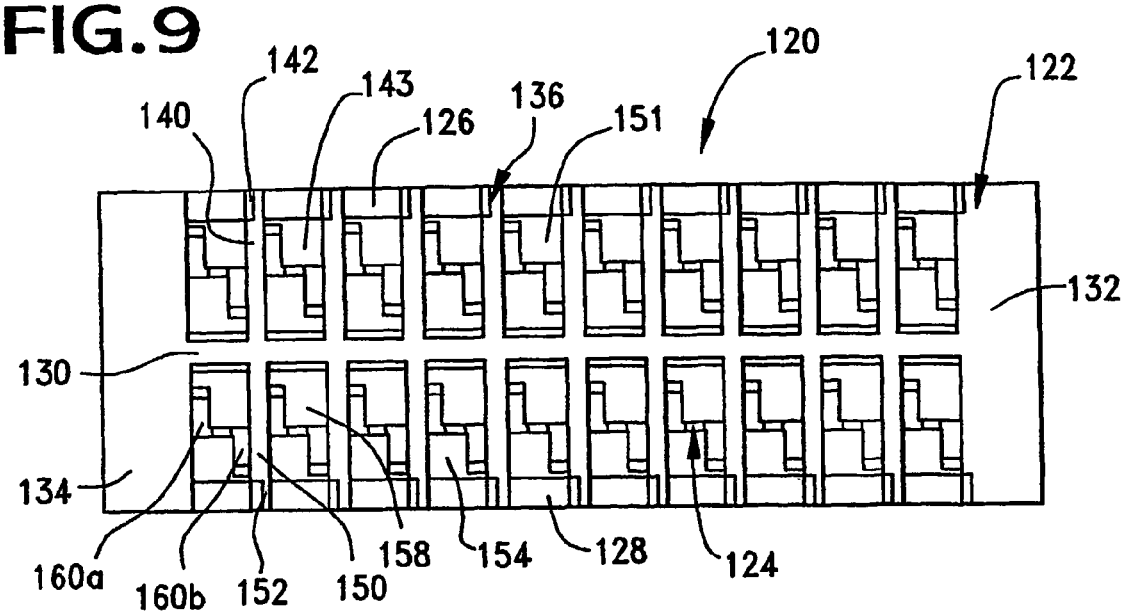
FIG.10
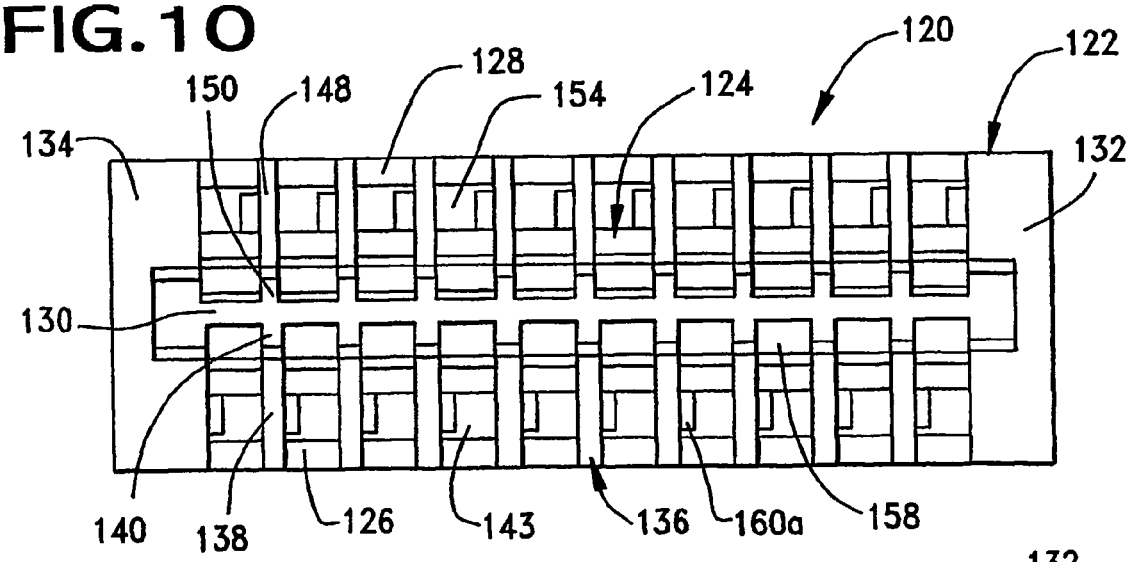
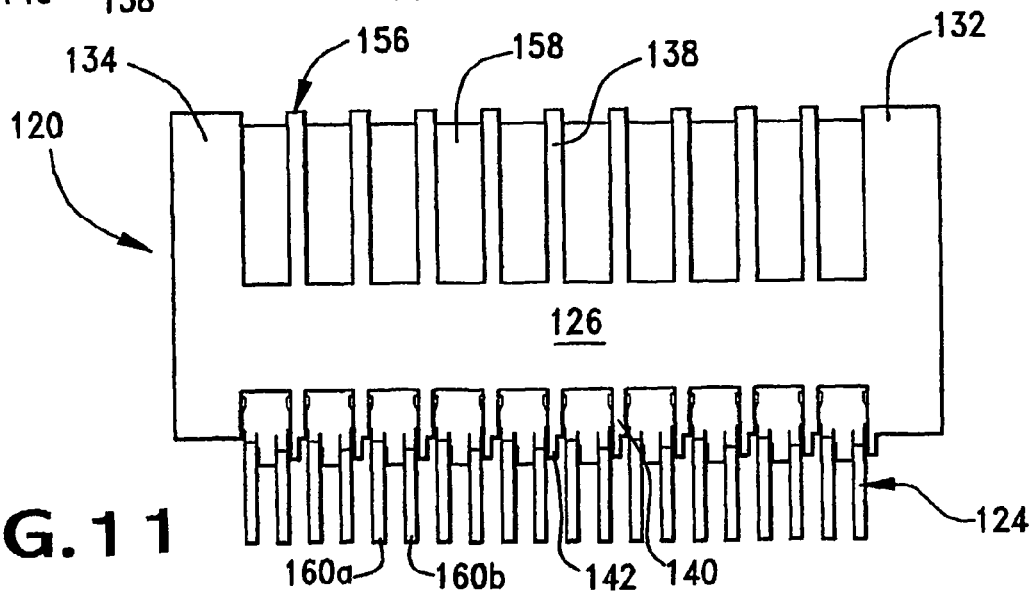
FIG.11

CONNECTOR WITH HEAT DISSIPATING FEATURES

FIELD OF THE INVENTION

This invention is generally directed to a connector which dissipates heat generated from electrical loading.

BACKGROUND OF THE INVENTION

As computers, servers and other electronic devices become smaller and power requirements increase, the need for power connectors to have a higher load carrying capacity is required.

The maximum amount of electrical load that is allowed to pass through a connector is limited, in part, to the temperature rise within the connector. The maximum temperature is reached when a temperature equilibrium is achieved. This occurs when the rate of internal heat generation due to electrical current loading equals the rate of heat dissipation from the connector to its surrounding environment. Prior art connectors are not designed to efficiently dissipate heat from the connector, thereby restricting the amount of load that the connector can carry.

The present invention provides a connector which overcomes the problems presented in the prior art and which provides additional advantages over the prior art, such advantages will become clear upon a reading of the attached specification in combination with a study of the drawings.

SUMMARY OF THE INVENTION

A connector includes a ribbed and slotted housing having at least one terminal provided between adjacent ribs. The housing includes first and second base walls, a central wall and a plurality of ribs connected to the first and second base walls and the central wall and extending outwardly therefrom. The ribs are spaced apart from each other such that a slot is defined between adjacent ribs. A least one terminal is positioned within each slot such that a large amount of the surface area of each terminal is exposed to the environment and air can flow over the surface area to dissipate heat from the at least one terminal.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identity like elements in which:

FIG. 9 is a bottom plan view of the connector of FIG. 8;

FIG. 10 is a top plan view of the connector of FIG. 8;

FIG. 11 is a front elevational view of the connector of FIG. 8;

DETAILED DESCRIPTION OF THE ILLUSTRATED EMBODIMENTS

Figure 1:
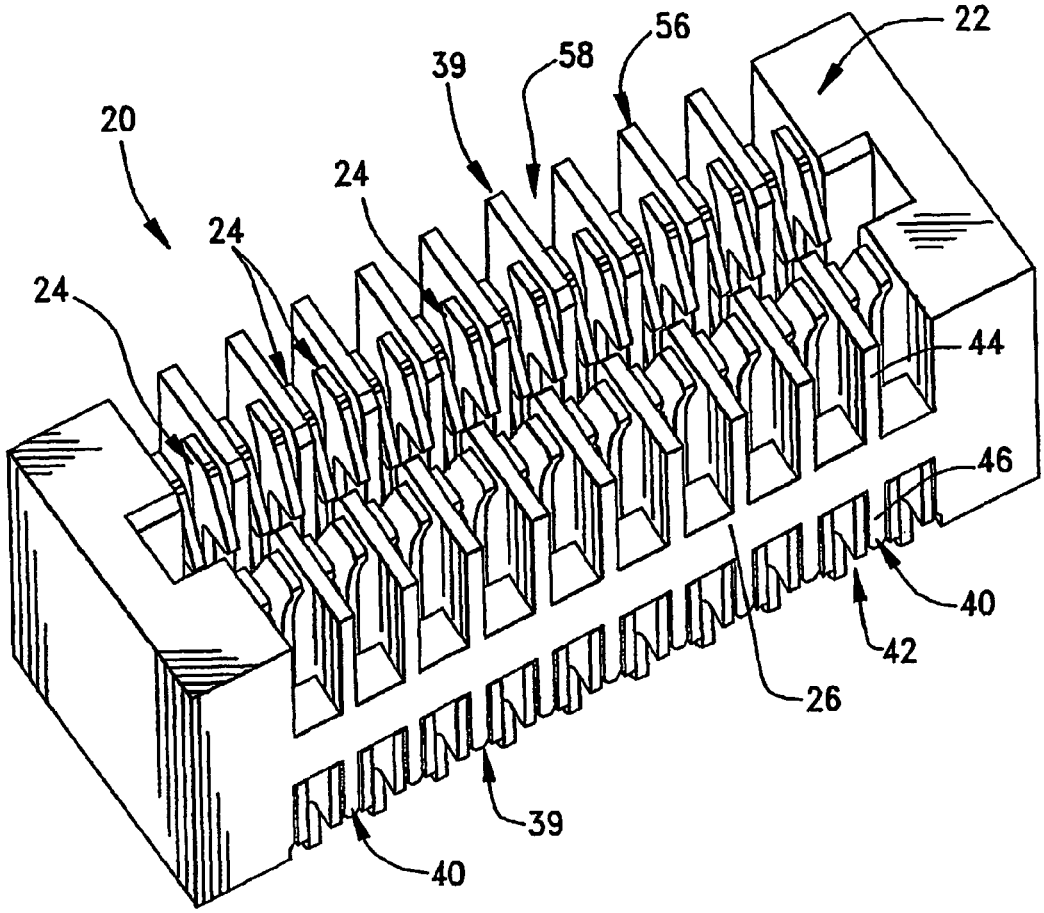
FIG. 1 is a perspective view of a connector which incorporates the features of a first embodiment of the invention.
Figure 2:
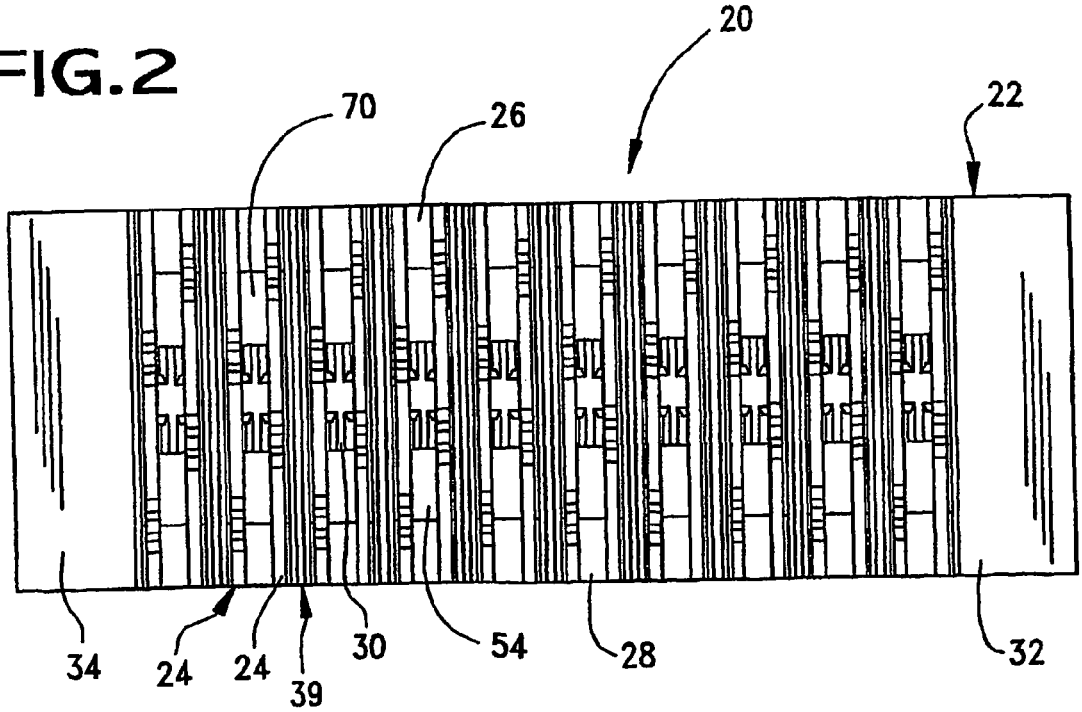
FIG. 2 is a bottom plan view of the connector of FIG. 1.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

A connector 20 which incorporates features of a first embodiment of the invention is shown in FIGS. 1-7. A connector 120 which incorporates features of a second embodiment of the invention is shown in FIGS. 8-13.

Attention is invited to the connector 20 shown in FIGS. 1-7. The connector 20 includes a dielectric housing 22 and a plurality of electrically conductive terminals 24 mounted within the housing 22. While the connector 20 is shown in the drawings with twenty terminals 24, it is to be understood that the connector 20 can any number of terminals 24, such as, for example, one hundred and sixty.

As is more clearly shown in FIGS. 2, 3 and 5-7, the housing 22 includes an elongated first base wall 26, an elongated second base wall 28 spaced apart from the first base wall 26, and an elongated central wall 30 between, and spaced from, the first base wall 26 and the second base wall 28. The first base wall 26, the second base wall 28 and the central wall 30 are generally rectangular. The first base wall 26, the second base wall 28 and the central wall 30 are connected together at one end thereof by a first end wall 32 and are connected together at an opposite end thereof by a second end wall 34 (the second end wall 34 is cut away in FIGS. 5-7). The end walls 32, 34 are perpendicular to the first base wall 26, the second base wall 28 and the central wall 30.

As is best illustrated in FIGS. 2, 3 and 5-7, the central wall 30 includes a plurality of cutouts 36 which are spaced apart from each other along the length of the side of the central wall 30 that faces the first base wall 26. The central wall 30 also includes a plurality of cutouts 38 which are spaced apart from each other along the length of the side of the central wall 30 that faces the second base wall 28.

A plurality of generally U-shaped ribs 39 extend from the first and second base walls 26, 28 and the central wall 30. Each rib 39 is formed from a first rib section 40, a second rib section 56 and a middle rib section 41 which extends between and connects the first rib section 40 and the second rib section 56.

The first rib sections 40 extend from the first base wall 26. The first rib sections 40 are spaced apart from each other along the length of the first base wall 26. As is most clearly shown in FIG. 7, each first rib section 40 includes a first portion 44, a second portion 46 and a middle portion 48. The first and second portions 44, 46 are generally rectangular.

Figure 3:
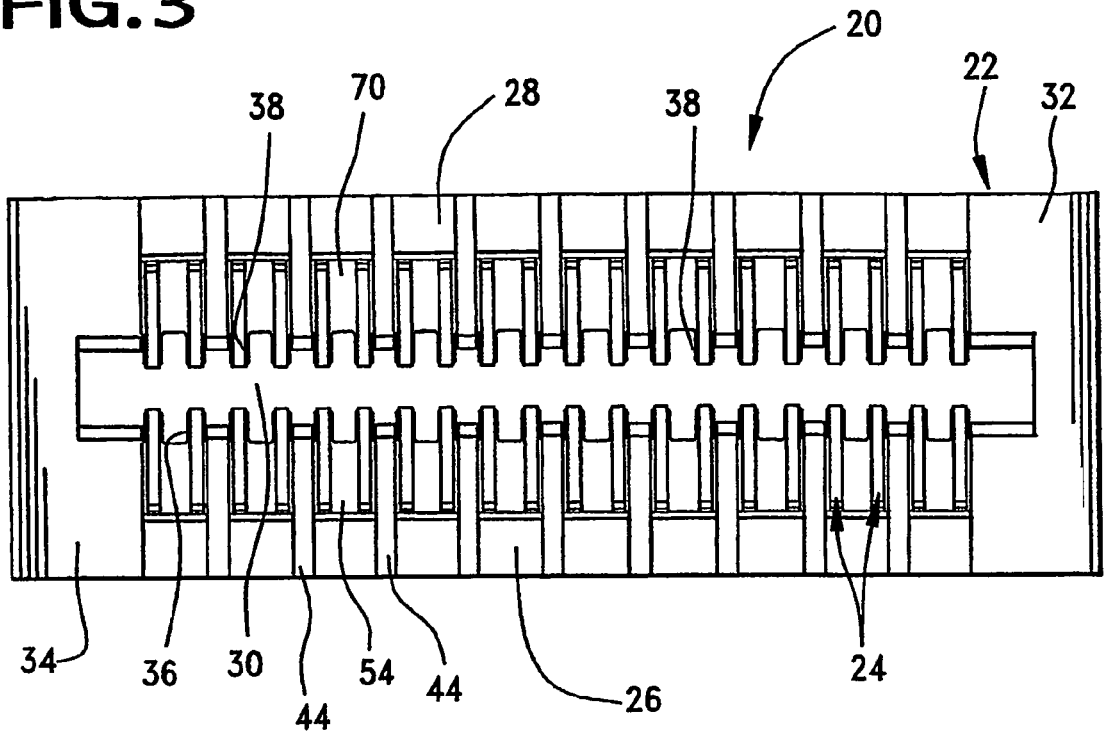
FIG. 3 is a top plan view of the connector of FIG. 1.
Figure 4:
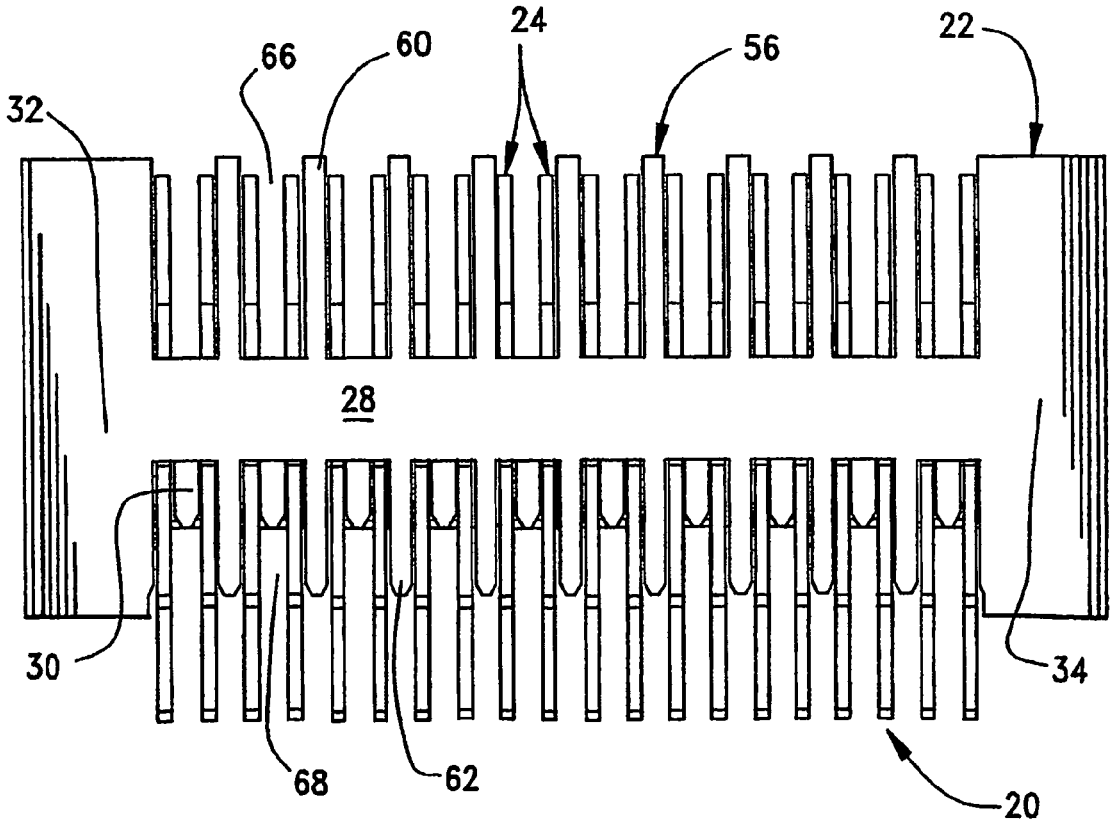
FIG. 4 is a front elevational view of the connector of FIG. 1.

The first portion 44 of each first rib section 40 extends from the first base wall 26 in a first direction and slots 50 are formed between the adjacent first portions 44. The second portion 46 of each first rib section 40 extends from the first base wall 26 in a second, opposite direction, such that slots 52 are formed between the adjacent second portions 46. The middle portions 48 of the first rib sections 40 are adjacent to the first base wall 26 and abut against the side of the central wall 30 which faces the first base wall 26. As best illustrated in FIG. 3, this forms a plurality of apertures 54 between adjacent first rib sections 40, the central wall 30 and the first base wall 26.

Figure 7:
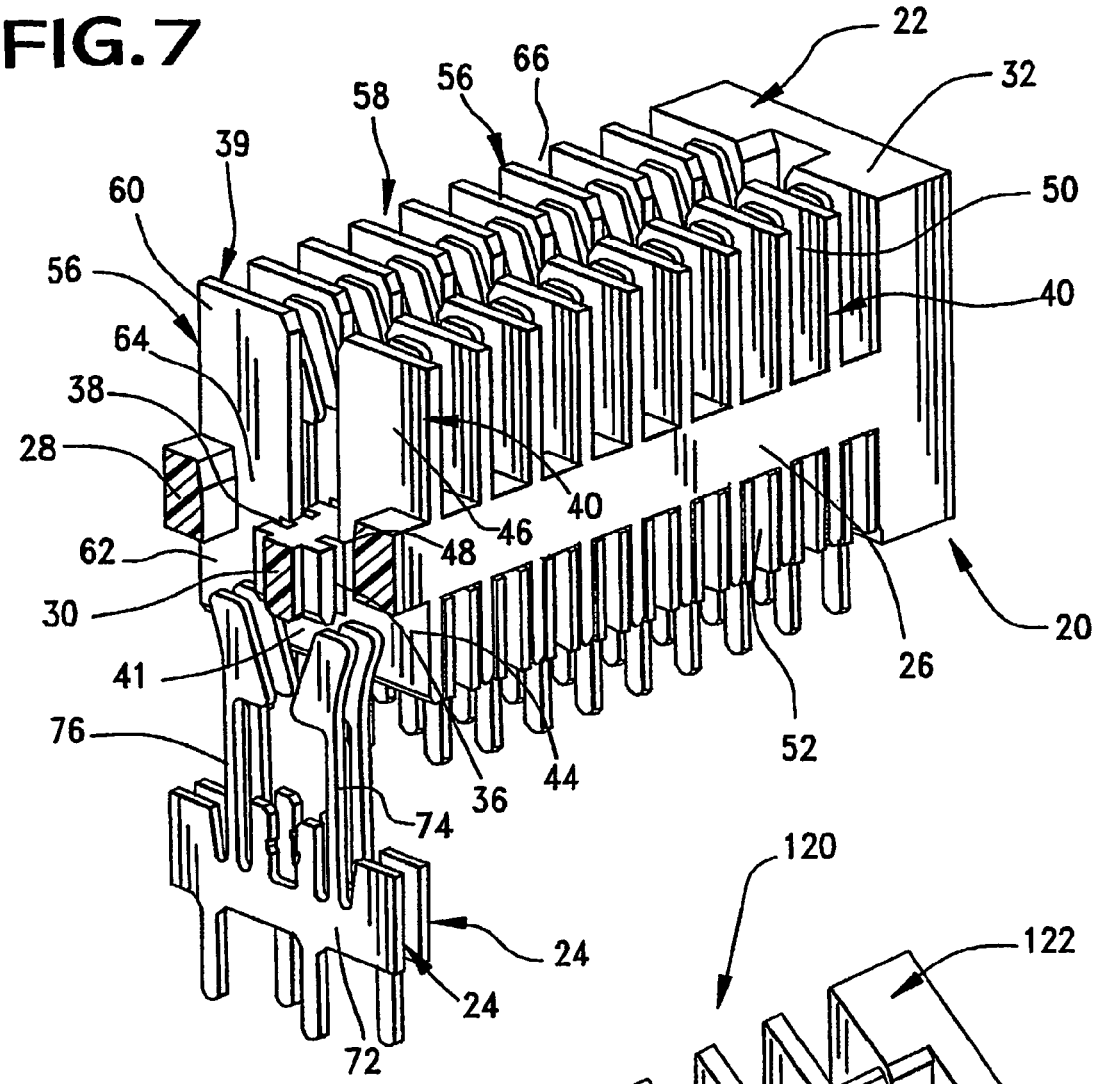
FIG. 7 is a perspective view of the connector of FIG. 1 with a portion of the housing cut away and with two terminals exploded therefrom.
Figure 8:
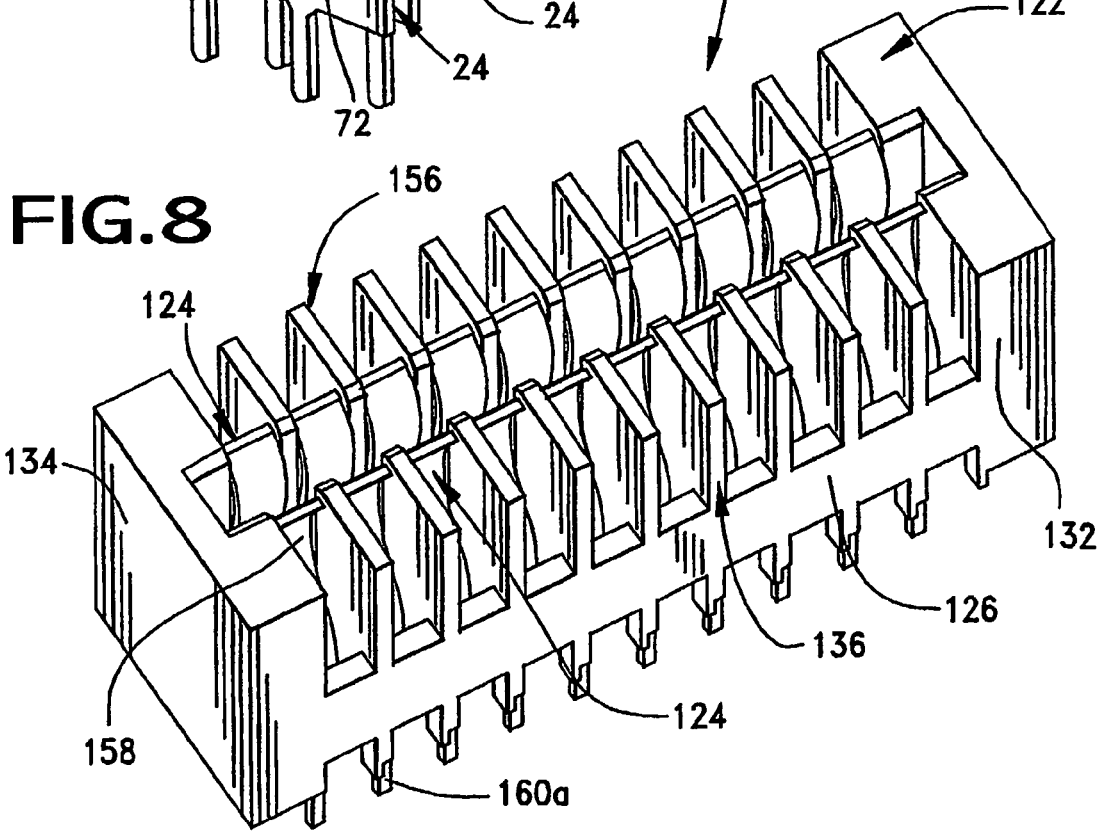
FIG. 8 is a perspective view of a connector which incorporates the features of a second embodiment of the invention.

The second rib sections 56 extend from the second base wall 28. The second rib sections 56 are spaced apart from each other along the length of the second base wall 26. Each second rib section 56 is aligned with a respective one of the first rib sections 40 along the length of the connector 20 and is connected thereto by the middle section 41 which extends underneath the central wall 30. Each second rib section 56 is identically formed to the respective first rib section 40 and as best illustrated in FIG. 7, includes a first portion 60, a second portion 62 and a middle portion 64. The first and second portions 60, 62 are generally rectangular. The first portion 60 of each second rib section 56 extends from the second base wall 28 in a first direction and slots 66 are formed between adjacent first portions 60. The slots 66 are aligned with the slots 50. The second portion 62 of each second rib section 56 extends from the second base wall 28 in a second, opposite direction, such that slots 68 are formed between adjacent second portions 62. The slots 68 are aligned with the slots 52. The middle portions 64 of the second rib sections 56 are adjacent to the second base wall 28 and abut against the side of the central wall 30 which faces the second base wall 28. This forms a plurality of apertures 70, as best illustrated in FIG. 7, between adjacent second rib sections 56, the central wall 30 and the second base wall 28. The apertures 70 are aligned with the apertures 54.

Figure 6:
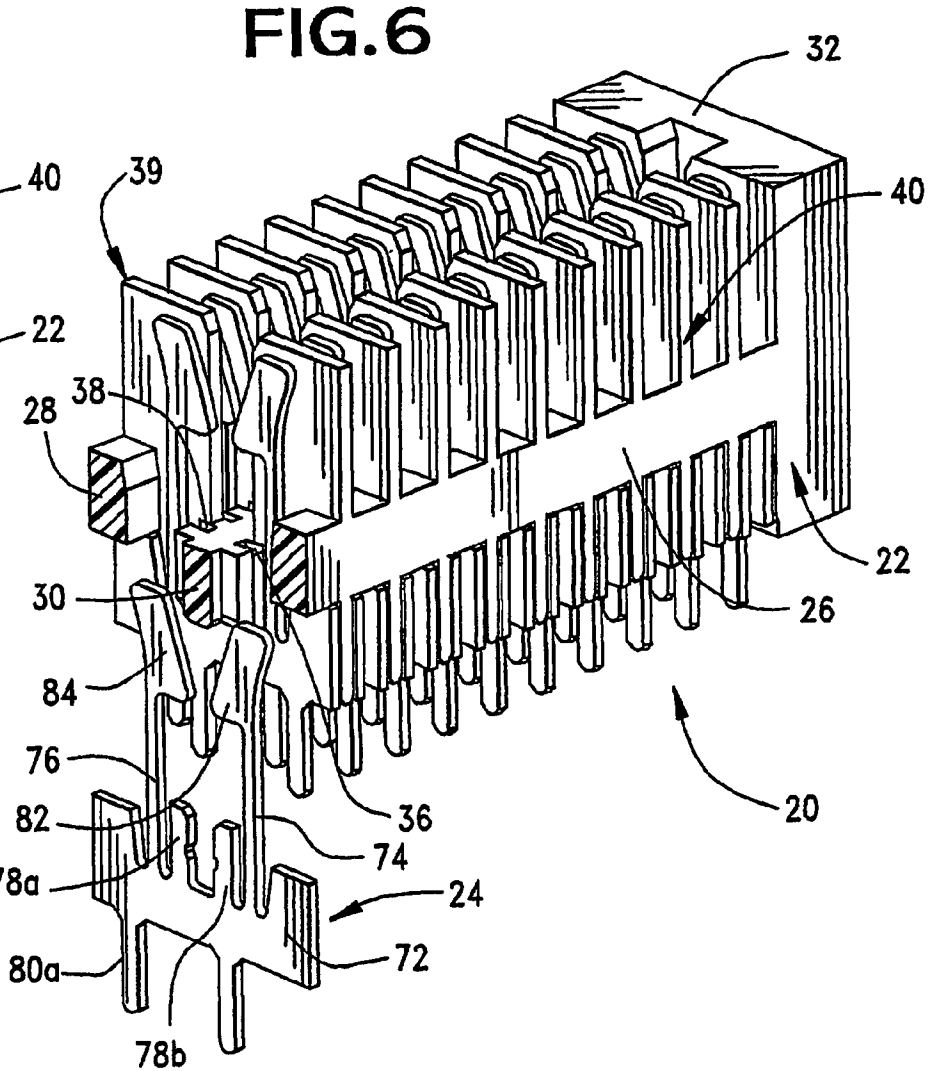
FIG. 6 is a perspective view of the connector of FIG. 1 with a portion of the housing cut away and with one terminal exploded therefrom.
Figure 5:
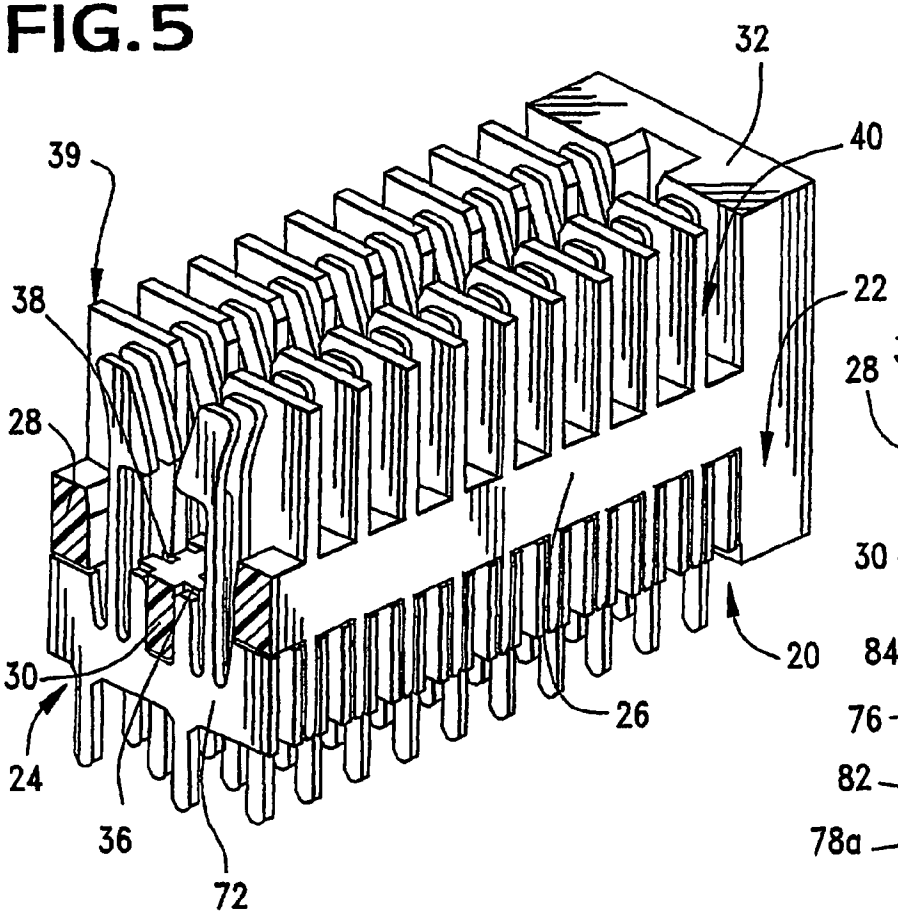
FIG. 5 is a perspective view of the connector of FIG. 1 with a portion of the housing cut away.

As best illustrated in FIGS. 5-7, each terminal 24 is seated between adjacent ribs 39 and includes a base portion 72, a first elongated portion 74 extending from one side of the base portion 72, a second elongated portion 76 extending from the same side of the base portion 72 and spaced from the first elongated portion 74, a first pair of spaced apart mounting legs 78*a*, 78*b* extending from the base portion 72 which are used to mount the terminal 24 to the central wall 30, and a second pair of spaced apart legs 80*a*, 80*b* extending from the opposite side of the base wall 72 and which are used to connect the connector 20 to an associated printed circuit board (not shown). The first elongated portion 74 includes an enlarged contact head 82 at the free end thereof which extends towards the second elongated portion 76. The first elongated portion 74 extends between the central wall 30 and the first base wall 28 through the aperture 54 and the enlarged contact head 74 extends into the slot 50. The second elongated portion 76 includes an enlarged contact head 84 at the free end thereof which extends towards the first elongated portion 74. The second elongated portion 76 extends between the central wall 30 and the second base wall 28 through the aperture 70 and the enlarged contact head 84 extends into the slot 66. The first pair of legs 78*a*, 78*b* extend along the opposite sides of the central wall 30 into the cutouts 38 and are connected thereto by suitable means, such as barbs or the like. The base portion 72 is seated within the slots 52, 66 and underneath the central wall 30. The second pair of legs 80*a*, 80*b* extend outwardly from the base wall 72 a distance which is greater than the distance the first portions 44, 60 of the first and second rib sections 40, 56 extend.

Preferably, two terminals 24 are provided between adjacent rib 39 and are spaced apart from each other within the slots 50, 52, 66, 68 and apertures 54, 70 therebetween such that spaces are provided between the respective terminals 24, the base walls 26, 28 and the central wall 20. If two terminals 24 are provided within the space between the adjacent rib 39, the terminals 24 have the same polarity, either positive or negative. This allows the connector 20 to carry more load than when a single terminal is used between the ribs. In addition, the two terminals 24 provide two load paths and improved contact reliability with the board (not shown) that is connected thereto.

As a result of the construction of the connector 20, a significant amount of surface area of each terminal 24 is exposed to the environment. This allows the heat generated from electrical loading to be dissipated by forced convection cooling when a fan or other suitable means is used to blow air across the printed circuit board and through the connector 20. In addition, due to the unique structure of the connector housing, the connector housing has a smaller thermal mass than conventional connector housings. Moreover, by virtue of not encapsulating the terminals within closed cavities in the housing, the terminals are better able to radiate heat to the outside environment, even in the absence of a fan to generate air flow across the exposed terminal surfaces.

If only one terminal 24 is provided between adjacent rib 39 within the slots 50, 52, 66, 68 and apertures 54, 70, spaces are also provided such that the terminal 24 does not contact at least one of the adjacent ribs 39. When air is blown, the air flows proximate to the printed circuit board, along the legs 80*a*, 80*b* of the terminal 24, along the base portion 72 which is proximate to second portions 46, 62 of the rib sections 40, 56, and along the elongated portions 74, 76 which are proximate to the first portions 44, 60 of the rib sections 40, 56 through the spaces. This design allows for a large surface area of each terminal 24 to be exposed to the environment such that air can flow over the surface area of the terminal 24 to dissipate heat from the terminal 24 and the printed circuit board by convection. Even if the spaces were not provided, because of the large surface area of each terminal 24 which is exposed to the environment on either side of the central wall 30 and between the ribs 39, air flow over the surface area of the terminals 24 dissipates heat from the terminals 24 and the printed circuit board by forced convection cooling.

If two terminals 24 are provided between the ribs 39, as preferred, the air flows proximate to the printed circuit board, along the legs 80*a*, 80*b* of the terminals 24, along the base portions 72 which are proximate to second portions 46, 62 of the rib sections 40, 56, and along the elongated portions 74, 76 which are proximate to the first portions 44, 60 of the rib sections 40, 56 through the spaces. This design allows for a large surface area of each terminal 24 to be exposed to the environment such that air can flow over the surface area of the terminal 24 to dissipate heat from the terminal 24 and the printed circuit board by convection. Even if the spaces were not provided, because of the large surface area of each terminal 24 which is exposed to the environment on either side of the central wall 30 and the ribs 39, air flow over the surface area of the terminals 24 dissipates heat from the terminals 24 and the printed circuit board by forced convection cooling.

Attention is now invited to the connector 120 shown in FIGS. 8-13. The connector 120 includes a dielectric housing 122 and a plurality of electrically conductive terminals 124 mounted within the housing 122. While the connector 120 is shown in the drawings with twenty terminals 124, it is to be understood that the connector 120 can any number of terminals 124, such as, for example, one hundred and sixty.

As is more clearly shown in FIGS. 9, 10, 12 and 13, the housing 122 includes an elongated first base wall 126, an elongated second base wall 128 spaced apart from the first base wall 126, and an elongated central wall 130 between, and spaced from, the first base wall 126 and the second base wall 128. The first base wall 126, the second base wall 128 and the central wall 130 are generally rectangular. The first base wall 126, the second base wall 128 and the central wall 130 are connected together at one end thereof by a first end wall 132 and are connected together at an opposite end thereof by a second end wall 134 (the second end wall 134 is cut away in FIGS. 12 and 13). The end walls 132, 134 are perpendicular to the first base wall 126, the second base wall 128 and the central wall 130.

Figure 13:
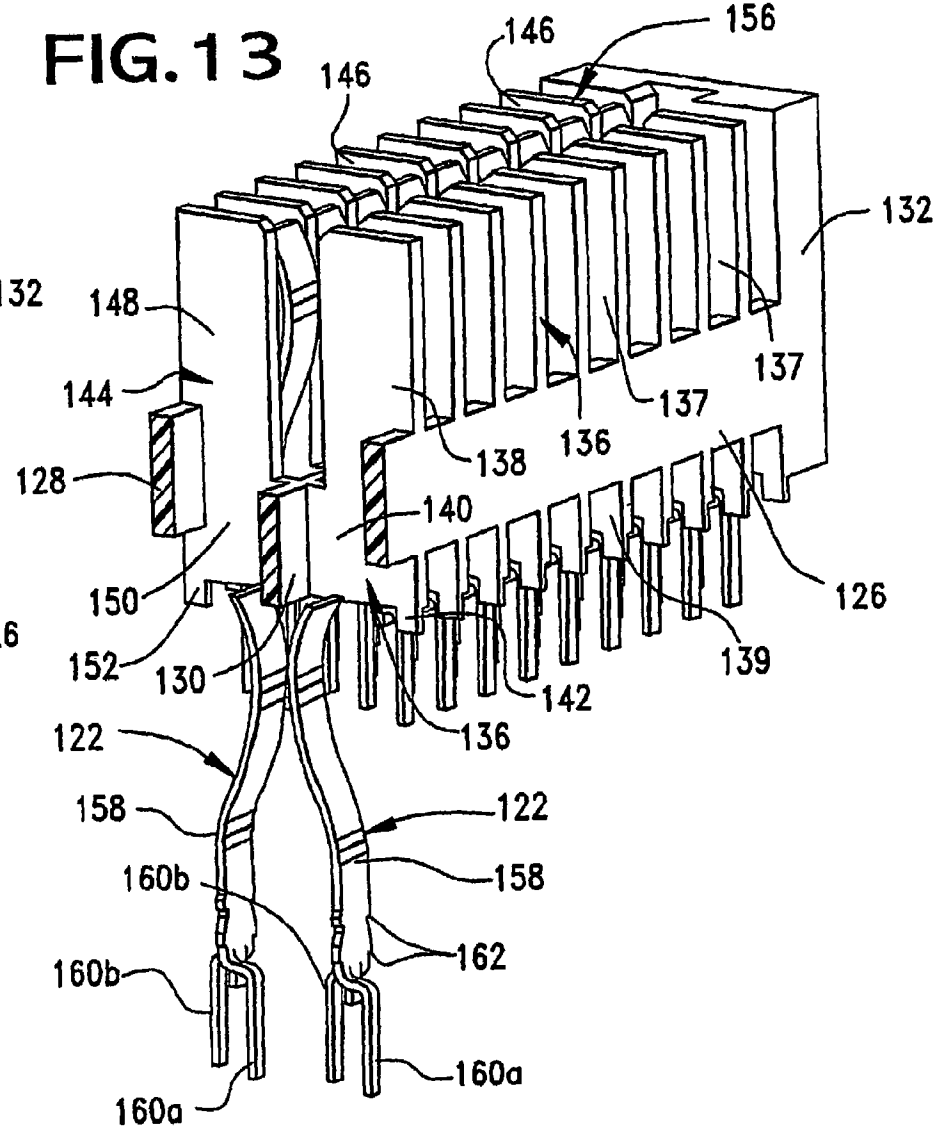
FIG. 13 is a perspective view of the connector of FIG. 8 with a portion of the housing cut away and with terminals exploded therefrom.

A plurality of generally L-shaped rib sections 136 extend from the first base wall 126 and between the first base wall 126 and the central wall 130. The L-shaped rib sections 136 are spaced apart from each other. As is best illustrated in FIG. 13, each rib section 136 is formed from a first rib portion 138, a second rib portion 140 and a third rib portion 142. The first rib portion 138 extends from the first base wall 126 in a first direction and slots 137 are formed between the adjacent first rib portions 138. The second rib portion 140 extends between the first base wall 126 and the central wall 130 and is integrally formed therewith. The second rib portion 140 also extends from the first base wall 126 in a second, opposite direction to that of the first rib portion 138. The third rib portion 142 extends from the second rib portion 140 and in a direction opposite to that which the first rib portion 138 extends. Slots 139 are formed between the adjacent second rib portions 140 and third rib portions 142 which extend in a direction opposite to that which the first rib portion 138 extends. As best illustrated in FIGS. 9 and 10, an aperture 143 is formed between adjacent second rib portions 140, the central wall 130 and the first base wall 126.

A plurality of generally L-shaped rib sections 144 extend from the second base wall 128 and between the second base wall 128 and the central wall 130 and are identically formed to the ribs sections 136. The L-shaped rib sections 144 are spaced apart from each other. The rib sections 144 are aligned with the respective rib sections 136 along the length of the connector 20. As is best illustrated in FIG. 13, each rib section 144 is formed from a first rib portion 148, a second rib portion 150 and a third rib portion 152. The first rib portion 148 extends from the second base wall 128 in a first direction and in the same direction as the first ribs portion 138. Slots 146 are formed between the adjacent first rib portions 148. The second rib portion 150 extends between the second base wall 128 and the central wall 130 and is integrally formed therewith. The second rib portion 150 also extends from the second base wall 128 in a second, opposite direction to that of the first rib portion 148. The third rib portion 152 extends from the second rib portion 150 and in a direction opposite to that which the first rib portion 148 extends. Slots 151 are formed between the adjacent second rib portions 150 and third rib portions 152 which extend in a direction opposite to that which the first rib portion 148 extends. As best illustrated in FIGS. 9 and 10, an aperture 154 is formed between adjacent second rib portions 150, the central wall 130 and the second base wall 128.

In combination, the respective rib sections 136, 144 and the portion of the central wall 130 therebetween form a generally U-shaped rib 156 in a like manner to that of the first embodiment.

Figure 12:
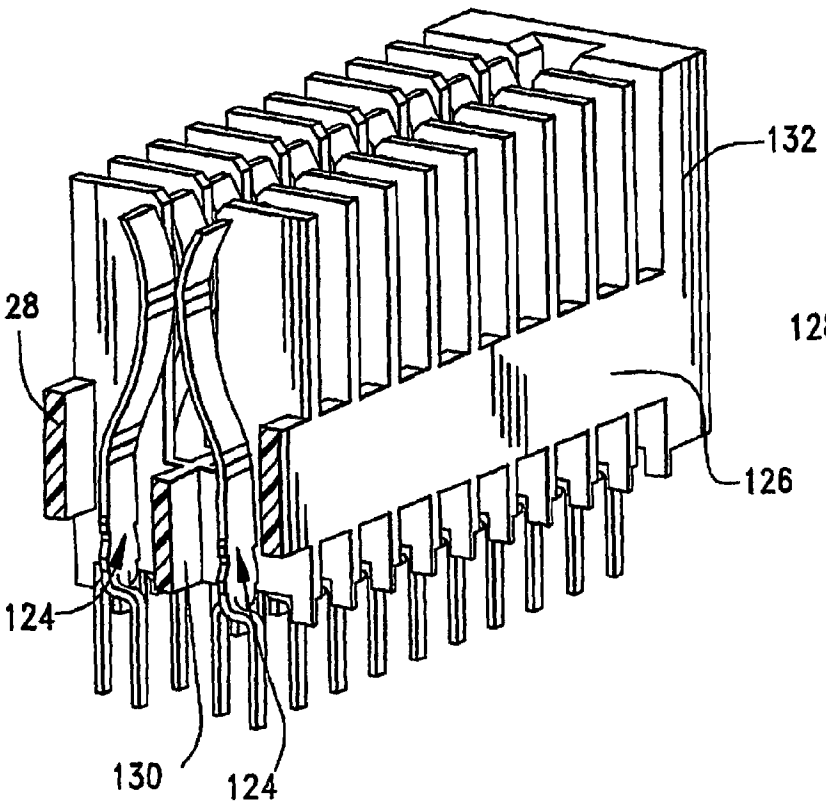
FIG. 12 is a perspective view of the connector of FIG. 8 with a portion of the housing cut away.

As best illustrated in FIGS. 12 and 13, a pair of terminals 124 are seated between adjacent ribs 156 on each side of the central wall 130. Each terminal 124 includes an elongated, curved contact portion 158 and a pair of legs 160*a*, 160*b* which are used to connect the connector 20 to an associated printed circuit board (not shown). The contact portion 158 includes a plurality of barbs 162 which bite into the respective second portions 140, 150 when the terminal is mounted within the housing 122. The terminals 124 are stamped and formed. On one side of the connector 20, the contact portion 158 of the respective terminals 124 sits within the respective slot 137, aperture 143 and slot 139 and the legs 160*a*, 160*b* extend from the second and third rib portions 140, 142. Spaces are formed between the terminal 124, the first base wall 126 and the rib sections 136. On the other side of the connector 20, the contact portion 158 of the respective terminals 124 sits within the respective slot 146, aperture 154 and slot 151 and the legs 160*a*, 160*b* extend from the second and third rib portions 150, 152. Spaces are formed between the terminal 124, the second base wall 128 and the rib sections 144.

As a result of the construction of the connector 120, a significant amount of surface area of the terminals 124 are exposed to the environment. This allows the heat generated from electrical current loading by the printed circuit board (not shown) and the terminals 124 to be dissipated by forced convection cooling when a fan or other suitable means is used to blow air across the printed circuit board and through the connector 120.

When air is blown across the connector 120, the air flows proximate to the printed circuit board, along the legs 160*a*, 160*b* of the terminals 124, along the contact portions 158 of the terminals 122 through the spaces. This design allows for a large surface area of each terminal 124 to be exposed to the environment such that air can flow over the surface area of the terminal 124 to dissipate heat from the terminal 124 and the printed circuit board by convection. Even if the spaces were not provided, because of the large surface area of each terminal 124 which is exposed to the environment on either side of the central wall 130 between the ribs 156, air flow over the surface area of the terminals 124 dissipates heat from the terminals 124 and the printed circuit board by forced convection cooling.

The design of the terminals 122 with large surface area has advantages in Ldi/dt and loop inductance. In order to effect di/dt, large planar areas in the primary current path can help lower loop inductance if the "+" and "−" terminals are electrically coupled (i.e. in near proximity to each other). The terminals 122 are arranged in the sequence VO+ VO+ VO− VO−. The primary electrical current path is through alternating VO+ and VO−. Loop inductance is defined as Lloop=L11+L22−2(L12), where L11 and L22 is the SELF inductance of each terminal 122 and L12 is the mutual inductance between the terminals 122. The goal in power delivery is to reduce the loop inductance. This goal is determined by the need to maintain a stable voltage (minimize voltage drop) as defined by the equation Vdrop=Lloop×dI/dt. From the Lloop equation, Lloop can be decreased by lower L11, lower L22, and/or increasing L12. To increase mutual inductance (L12), the current carrying paths of the terminals 122 are in close proximity to each other. To decrease the self inductance (L11 and L22), the terminals 122 have a relatively large cross-sectional area.

Combined in this connector 120, the result is an interconnect that results in less of a voltage drop as compared to other connectors in the same system. That is to say, the terminals 122 between adjacent ribs 156 can be a differential pair (i.e., one is a V+ and the other is a V−), and that the closer the spacing between the terminals 122 that make up the differential pair, the lower the loop inductance that is generated by the differential pair. In addition to decreasing the spacing between the terminals 122 to reduce the loop inductance, the loop inductance can also be reduced by using terminals 122 that have increased surface areas.

In each embodiment, because the housing 22, 122 is formed with ribs 39, 156, less material is used and the housing 22, 122 itself retains less heat than prior art devices. In addition, because less material is used for the housing 22, 122, the connector 20, 120 has a decreased cost of manufacture over prior art devices. The housing 22, 122 is easy to manufacture by molding because it does not involve a side pull during molding.

While preferred embodiments of the present invention are shown and described, it is envisioned that those skilled in the art may devise various modifications of the present invention without departing from the spirit and scope of the appended claims.

The invention claimed is:

1. A connector comprising:

a housing including a first housing base wall and a second housing base wall connected to said first housing wall and spaced therefrom, said first housing base wall having an inner side, an outer, opposite side, a top side and a bottom side, said second housing base wall having an inner side, an outer, opposite side, a top side and a bottom side, said inner side of said first housing base wall facing said inner side of said second housing base wall, a plurality of first top rib portions extending from said top wall of said first housing base wall and spaced apart from each other such that a first top slot portion is defined between adjacent first top rib portions, said first top slot portion being open to the outer side of said first housing base wall, a plurality of second top rib portions extending from said top wall of said second housing base wall and spaced apart from each other such that a second top slot portion is defined between adjacent second top rib portions, said second top slot portion being open to the outer side of said second housing base wall;

a plurality of first bottom rib portions extending from said bottom wall of said first housing base wall and spaced apart from each other such that a first bottom slot portion is defined between adjacent first bottom rib portions, said first bottom slot portion being open to the outer side of said first housing base wall, a plurality of second bottom rib portions extending from said bottom wall of said second housing base wall and spaced apart from each other such that a second bottom slot portion is defined between adjacent second bottom rib portions, said second bottom slot portion being open to the outer side of said second housing base wall;

adjacent ones of said first top slot portion, said second top slot portion, said first bottom slot portion and said second bottom slot portion forming a slot such that a plurality of slots are formed; and a terminal positioned within each of said slots and connected to said housing.

2. A connector as defined in claim 1, wherein each terminal includes a terminal base wall, a first terminal portion extending from said terminal base wall and a second terminal portion extending from said terminal base wall in the same direction, said first and second terminal portions being positioned within said first slot portions of a respective slot, said terminal base wall being positioned within said second slot portions of a respective slot.

3. A connector as defined in claim 2, wherein said housing further includes a housing central wall provided between said first and second housing base walls such that a first aperture is provided between said housing central wall and said first housing base wall and a second aperture is provided between said housing central wall and second housing base wall, said first terminal portion being positioned within a respective first aperture and said second terminal portion being positioned within a respective second aperture.

4. A connector as defined in claim 3, wherein each said terminal further includes means for connecting said terminal to an associated printed circuit board, said second terminal portion extending beyond ends of said second rib portions.

5. A connector as defined in claim 3, wherein each terminal further includes means for connecting said terminal to said housing.

6. A connector as defined in claim 3, wherein each terminal further includes an enlarged head on said first terminal portion and an enlarged head on said second terminal portion.

7. A connector as defined in claim 3, wherein said first aperture is wider than a width of said first terminal portion such that air can flow through said first aperture, and wherein said second aperture is wider than a width of said second terminal portion such that air can flow through said first aperture.

8. A connector as defined in claim 7, wherein two terminals are provided between respective pairs adjacent ribs and said first aperture is wider than a width of said two terminals such that air can flow through said first aperture, and wherein said second aperture is wider than a width of said two terminals such that air can flow through said second aperture.

9. A connector as defined in claim 1, wherein said housing includes a central wall and said first housing base wall and said second housing base wall are connected to said housing central wall, said first housing base wall, said housing central wall and said second housing base wall being spaced apart from each other such that a first aperture is provided between said housing central wall and said first housing base wall and a second aperture is provided between said housing central wall and second housing base wall, each terminal being positioned within said apertures such that a surface area of each terminal is exposed to the environment and air can flow over said surface area to dissipate heat from each terminal.

10. A connector as defined in claim 9, wherein two terminals are provided within said apertures.

11. A connector as defined in claim 9, wherein each terminal includes a terminal base wall, a first terminal portion extending from said terminal base wall and a second terminal portion extending from said terminal base wall in the same direction, said first terminal portion being positioned within said first aperture and a respective slot, said second terminal portion being positioned within said second aperture and a respective slot, said terminal base walls being positioned within a respective slot.

12. A connector as defined in claim 11, wherein said first aperture is wider than a width of said first terminal portion such that air can flow through said first aperture, and wherein said second aperture is wider than a width of said second terminal portion such that air can flow through said second aperture.

13. A connector as defined in claim 11, wherein two terminals are provided within said apertures.

14. A connector as defined in claim 13, wherein said two terminals provided within said aperture have the same polarity.

* * * * *